US005710554A

United States Patent [19]

Pettler et al.

[11] Patent Number: 5,710,554

[45] Date of Patent: Jan. 20, 1998

[54] PAVEMENT ICE DETECTOR

[76] Inventors: Peter R. Pettler, 10622 Banner Mine Way, Nevada City, Calif. 95959; Lloyd H. Roberts, 14647 Pammy Way, Grass Valley, Calif. 95949

[21] Appl. No.: 595,569

[22] Filed: Feb. 1, 1996

[51] Int. Cl.[6] ..... G08G 1/09

[52] U.S. Cl. ..... 340/905; 340/901; 340/580; 340/962; 73/37

[58] Field of Search ..... 340/905, 901, 340/902, 903, 580, 581, 582, 583, 584, 962; 73/170.26, 37; 244/134 F

[56] References Cited

U.S. PATENT DOCUMENTS

| | | | |
|---|---|---|---|
| 2,641,928 | 6/1953 | Howell | 73/170.26 |
| 2,699,537 | 1/1955 | Sederstrom | 340/962 |
| 2,755,456 | 7/1956 | Bursack | 244/134 D |
| 2,953,021 | 9/1960 | Goettelman | 73/170.26 |
| 3,057,198 | 10/1962 | Crouchman | 73/170.26 |
| 3,086,393 | 4/1963 | Silverschotz | 73/170.26 |
| 4,053,127 | 10/1977 | Edington | 244/134 F |
| 4,897,597 | 1/1990 | Whitener | 324/693 |
| 5,301,905 | 4/1994 | Blaha | 244/134 F |
| 5,416,476 | 5/1995 | Rendon | 340/905 |
| 5,484,121 | 1/1996 | Padawer et al. | 244/134 F |

*Primary Examiner*—Jeff Hofsass
*Assistant Examiner*—Ashok Mannava

[57] ABSTRACT

A small puff of air is periodically exhausted through a semi-permeable stainless mesh (23) filter upward through the plane of the roadway surface. The puff of air is created by a miniature air pump (14) and timer, typically On one half second and Off 30 seconds. The timing can be adjustable. The puff of air is delivered to the sensor (20) through hose (5). When ice on pavement has formed over the sensor (20), it blocks the release of the air puff. This causes pressure to build up, triggering the pressure switch (16) which then turns on output switch (17) which can then be used to turn on any number of warning devices.

5 Claims, 3 Drawing Sheets

PAVEMENT ICE DETECTOR

BACKGROUND—FIELD OF INVENTION

This invention relates to the detection of ice on pavement surfaces, such as highways and airport pavements, to alert the appropriate maintenance personnel and the traveling public of the ice hazard. Pneumatic and electronic principles are used in this invention.

BACKGROUND—DESCRIPTION OF PRIOR ART

No prior art or closely related subjects have been found for a pavement ice detector. Writer Roberts has worked in the field of highway design construction and maintenance for over 31 years, and has been unable to find descriptive material for such a device.

There are ice detectors, such as, detecting ice on the wings of aircraft using a vibrating mechanical probe, or in water, snow, and other liquids using thermometers or other temperature measuring devices. These systems use different technologies than used in this invention.

Indirect sensing methods which measures the temperature of the pavement and/or air do not reliably indicate whether or not ice has formed on the pavement surface. Moisture at or below freezing point must also be present as a prerequisite for the formation of surface ice. Other factors such as surface winds and traffic conditions affect the icing progress. These parameters often interact in such a way that local icing may cover only a few yards of pavement over many miles of highway.

OBJECTS AND ADVANTAGES

The object of our invention is to detect the presence of ice, only when said ice has actually formed on the pavement. The invention can detect ice on highway, road, street and airport pavements, bridge decks, and sidewalks. The invention will be particularly useful on bridge decks. In addition to detecting the formation of ice, the said invention can be used;

(a) to activate traffic warning devices, thereby providing a warning to the traveling public; and, (b) to send a signal to personnel responsible for maintenance of the facility indicating that ice has formed at a particular location.

Our invention is unique in that it uses a small puff of air, released through the plane of the pavement surface, to detect the presence of ice.

The invention has the potential of saving lives by warning the public of dangerous ice conditions on highways and bridges.

An additional advantage of our invention is that it is versatile and reliable. The components, contained in the signal equipment box, can support a number of the sensors installed at different pavement locations, giving better coverage of areas where ice might form. Said invention is easily installed in existing pavements and on bridge decks. The installation is similar to installing detection loops for traffic signals, and there are contractors available for such installation.

The invention is completely self contained. It uses very little power. The unit can be operated by batteries which could be recharged using a solar generator.

Further objects and advantages are that the whole devise is easy to manufacture and is very inexpensive. Parts of the invention installed in the pavement can be easily replaced if damaged by snow plows or other equipment.

DRAWING FIGURES

REFERENCE NUMERALS IN DRAWINGS

Figure 1:
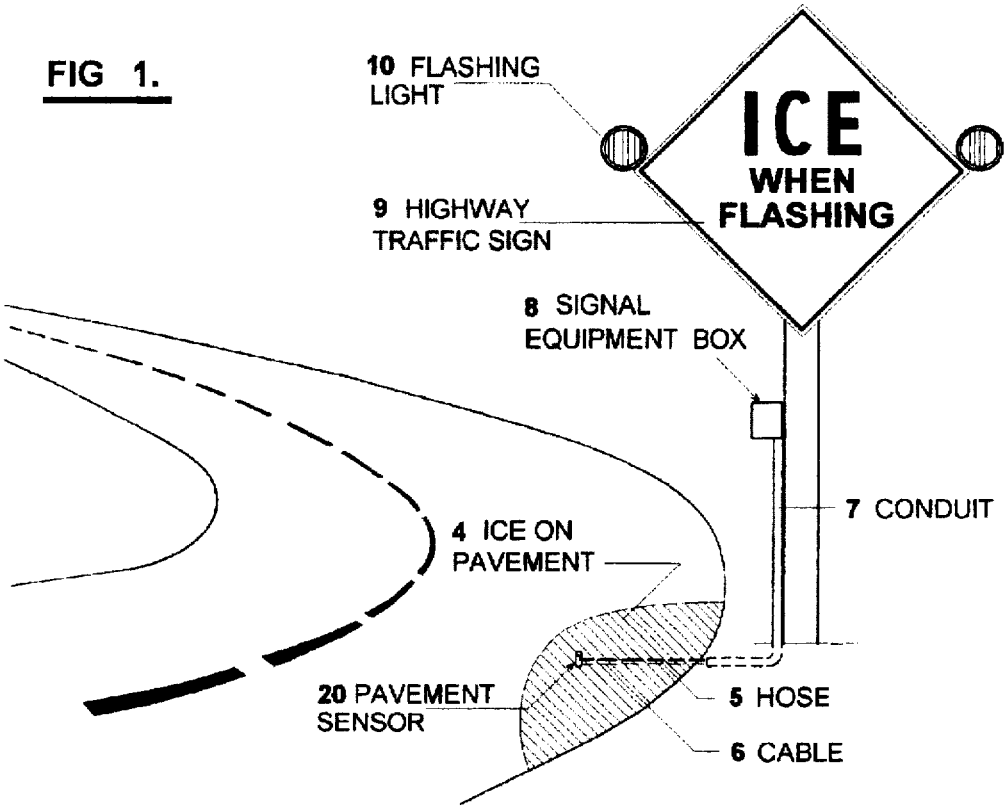
FIG. 1 is an overall view of our invention, including using an optional traffic warning sign.

4 Ice on pavement
5 Air transmission hose
6 Cable
7 Conduit
8 Signal equipment box
9 Highway traffic sign
10 Flashing light
11 Battery power supply
12 Power switch
13 Electric timer
14 Air pump
15 Air surge tank
16 Pressure switch
17 Output switch
20 Pavement sensor
21 Body
22 Chamber
23 Mesh
24 Recess
25 Hole
26 Pipe
27 Cavity
28 Temperature sensor
30 Ground wire
31 Positive wire
32 Plus wire
33 Voltage wire
34 Timer wire
35 Motor wire
36 Signal wire

DESCRIPTION OF THE INVENTION

FIG. 1 shows the overall layout of our installed invention.

Pavement sensor 20 is the main element of our invention. See complete description under FIG. 3 below. Pavement sensor 20 is installed in the pavement where the formation of ice on pavement 4 is anticipated. Pavement sensor 20 is connected to the other components by hose 5 and cable 6.

Conduit 7 carries hose 5 and cable 6 from pavement sensor 20 to signal equipment box 8. Signal equipment box 8 contains all the rest of the working parts of this invention.

Highway traffic sign 9 and flashing light 10 are optional items shown here to illustrate the usefulness of the invention.

Figure 2:
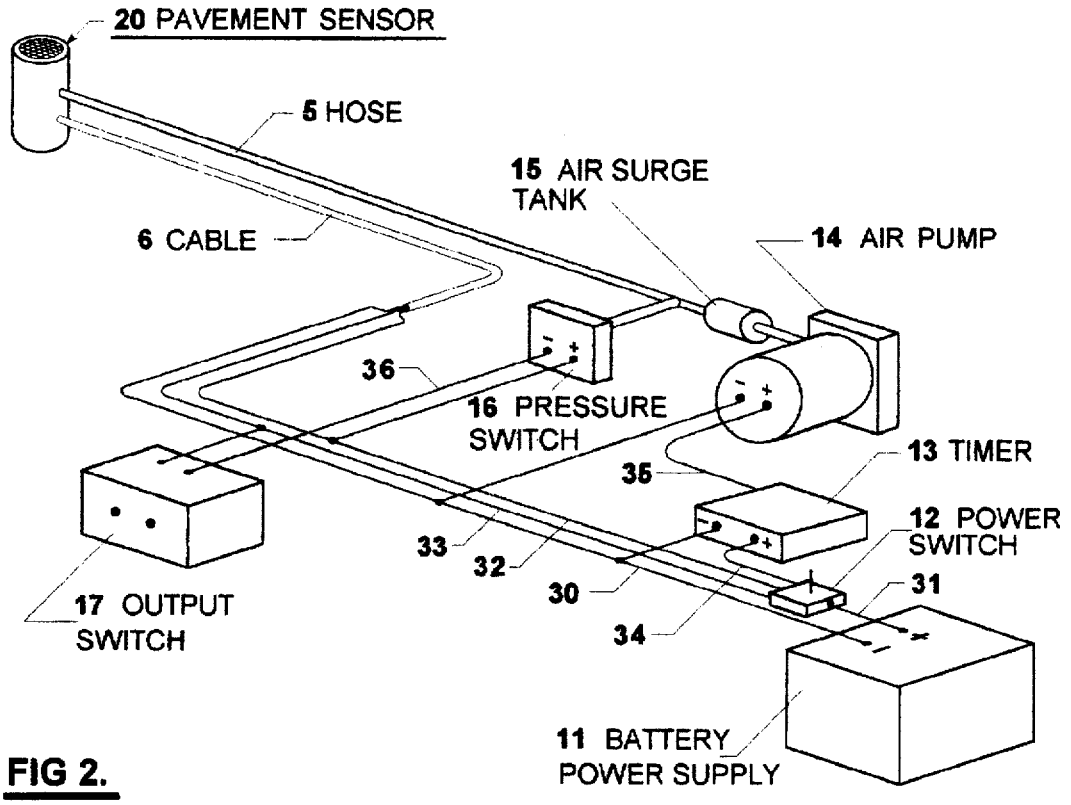
FIG. 2 is a perspective view of all the required component parts.

FIG. 2 shows a perspective view of all the component parts of our invention. All of the components except pavement sensor 20 are contained in signal equipment box 8.

Battery power supply 11 can be any device providing from 6 to 12 volts DC. Battery power supply 11 could be recharged using a solar generator. Our test models used a 9 volt transistor battery.

The power switch 12 can be a simple manual electric switch. Power switch 12 turns on the power for all components of the invention. For some applications, power switch 12 could be split with a relay, activated by some other electrical device, such as, temperature sensor 28. This would turn on the power to timer 13 and air pump 14 only when the temperature is below a certain degree.

Timer 13 is a simple electronic timer using a LM 555 to provide an on time of approximately a half second and an off time of approximately 30 seconds. Electric timer 13 supplies electric power to air pump 14.

Air pump 14 is a miniature 12 volt air compressor capable of producing flows to 2 LPM and pressures to 6 psi of compressed air. We have used one produced by Gillian Instrument Corp. 35 Fairfield Place, West Caldwell, N.J. 07006. Air pump 14 supplies air to air surge tank 15.

Air surge tank 15 is a small, 1.5 cubic inch in capacity, metal chamber. Air surge tank 15 is connected to pressure switch 16 and pavement sensor 20 by hose 5.

Pressure switch 16 is a miniature adjustable pneumatic switch with a range of 0 to 10 psi. We used Model PSF 102 produced by World Magnetics, 810 Hastings, Traverse City, Mich. 49686. Pressure switch 16 provides electric continuity to output switch 17.

Output switch 17 is a relay or other signal device. It could connect to a telephone land line or a cellular phone. In FIG. 1 it turns on flashing light 10.

Ground wire 30 is the wiring necessary to connect the negative terminals on all of the electronic components to the negative or ground terminal on battery power supply 11.

Positive wire 31 is the wiring necessary to get positive voltage from battery power supply 11 to power switch 12.

Plus wire 32 is the wiring necessary to get switched positive voltage from power switch 12 to pressure switch 16, output switch 17 and thermometer 28 and any other components needing positive voltage.

Voltage wire 33 carries the variable voltage from temperature sensor 28 to output switch 17 and power switch 12.

Timer wire 34 is the wiring necessary to connect power switch 12 to timer 13.

Motor wire 35 is the wiring necessary to connect timer 13 to air pump14.

Signal wire 36 carries the output signal from pressure switch 16 to output switch 17.

Figure 3:
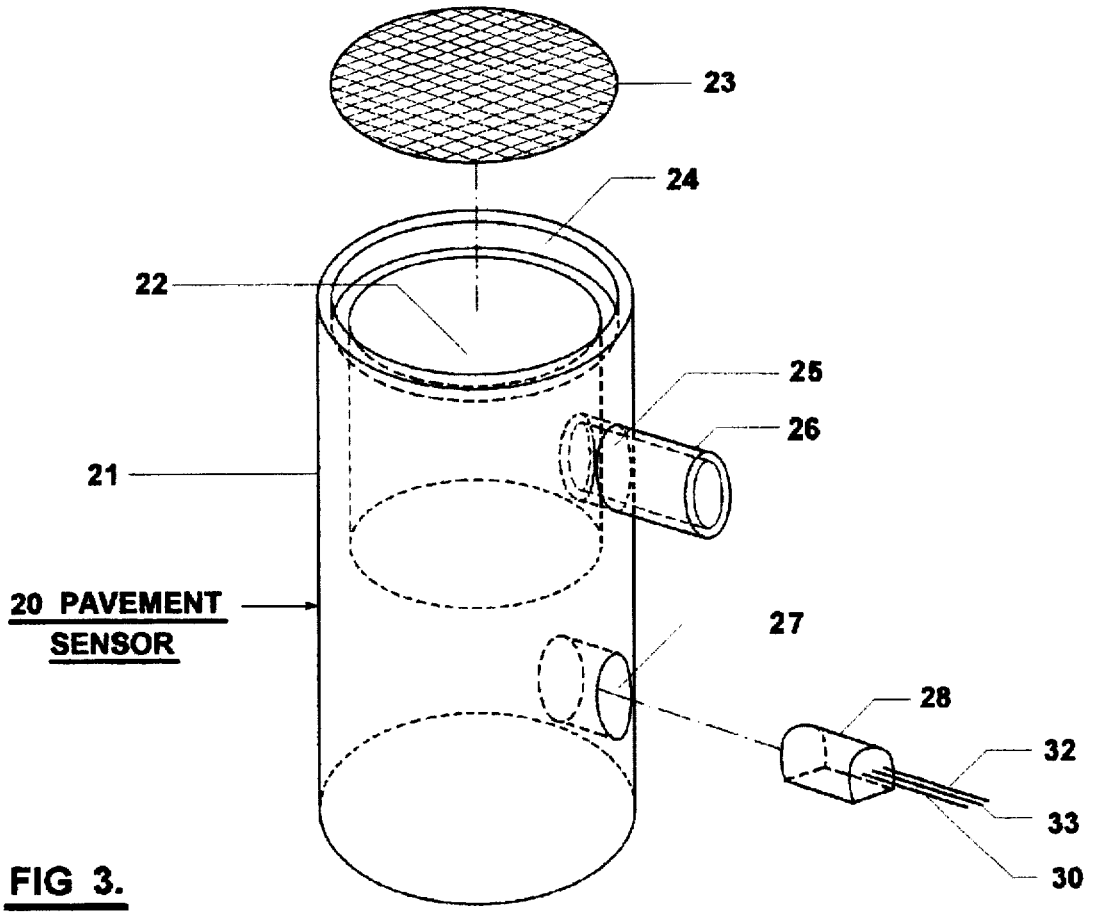
FIG. 3 is a perspective view of the details of the pavement sensor.

FIG. 3 shows the component parts of pavement sensor 20:

Body 21 is a short piece of one half inch diameter stainless steel rod milled to provide the following items;

a. Chamber 22 is to provide passage from hose 5 to mesh 23.

b. Recess 24 is to hold mesh 23 above the chamber 22.

c. Hole 25 is for a press fight of pipe 26 into body 21.

d. Cavity 27 provides space for temperature sensor 28.

Mesh 22 is a semi-permeable stainless steel filter, which is press fit into recess 24.

Pipe 26 provides a connection for hose 5 to attach to body 21.

Temperature sensor 28 is a an electronic semi conductor device, LM 34. Temperature sensor 28 fits into cavity 27 and is connected to other components by positive wire 32, ground wire 30, and voltage wire 33, all three wires contained in cable 6.

SUMMARY AND OPERATION OF THE INVENTION

A small puff of air, lasting about one half second, is released every 30 seconds upward out of the pavement sensor 20 through mesh 23. When ice on pavement 4 has formed over the mesh 23, it blocks the release of the air puff. This causes pressure to build up, triggering the pressure switch 16, which then turns on the output switch 17. The output switch 17 can turn on any number of warning devices or sends a message to the users that ice has formed. The most probable warning devices are shown in FIG. 1 as highway traffic sign 9 and flashing light 10.

The small puff of air is produced by the timer 13 turning on air pump 14 every 30 seconds. The time period can be altered to meet specific requirements of a site. The length of the hose 5 could require a longer timing period.

Air surge tank 15 serves to equalize the air pressure. Hose 5 carries the air puff from the air surge tank 15 to pavement sensor 20. When ice on pavement 4 blocks the puff of air from coming through mesh 23, air pressure builds up and backs through hose 5 to pressure switch 16.

We claim:

1. A pavement ice detector comprising: a sensor imbedded in the pavement, a semi-permeable mesh on the top surface of said sensor, a timer and air pump creating a puff of air exhausting through said sensor and a means to signal the buildup of air pressure in said sensor.

2. The aforementioned sensor of claim 1 is made of stainless steel contains no moving parts or critical dimensions, making it practically indestructible by snow plows, tire chains, tire studs, and salt or other deicing chemicals.

3. Further, the aforemontioned sensor of claim 1, is designed to be installed in the pavement where the tires of traveling vehicles would encounter ice, thus indicating real ice conditions.

4. The aforementioned periodical puff of air of claim 1 is very low pressure, allowing ice to form, from a very thin film of moisture between each individual puff.

5. Further, the aforementioned periodical puff of air of claim 1, also saves on battery power consumption.

* * * * *